US010755627B2

(12) United States Patent
Chaji et al.

(10) Patent No.: US 10,755,627 B2
(45) **Date of Patent: *Aug. 25, 2020**

(54) CORRECTION FOR LOCALIZED PHENOMENA IN AN IMAGE ARRAY

(71) Applicant: Ignis Innovation Inc., Waterloo (CA)

(72) Inventors: Gholamreza Chaji, Waterloo (CA); Mehdi Torbatian, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/221,721

(22) Filed: Dec. 17, 2018

(65) Prior Publication Data

US 2019/0122606 A1 Apr. 25, 2019

Related U.S. Application Data

(63) Continuation of application No. 15/675,297, filed on Aug. 11, 2017, now Pat. No. 10,186,190, which is a (Continued)

(51) Int. Cl.
*G09G 3/3208* (2016.01)
*G09G 3/3225* (2016.01)

(52) U.S. Cl.
CPC ..... *G09G 3/3208* (2013.01); *G09G 3/3225* (2013.01); *G09G 2300/0413* (2013.01); *G09G 2300/0819* (2013.01); *G09G 2320/029* (2013.01); *G09G 2320/0233* (2013.01); *G09G 2320/0285* (2013.01); (Continued)

(58) Field of Classification Search
CPC ..... G09G 2320/043; G09G 2320/0233; G09G 2300/0861; G09G 2320/045; G09G 3/3258; G09G 3/3291; G09G 2300/0852; G09G 2320/0295; G09G 2310/0251; G09G 3/3225; G09G 2310/027
See application file for complete search history.

(56) References Cited

U.S. PATENT DOCUMENTS 9,111,485 B2 * 8/2015 Chaji ..... G09G 3/3208
9,437,137 B2 * 9/2016 Chaji ..... G09G 3/3266
(Continued)

*Primary Examiner* — Olga V Merkoulova
(74) *Attorney, Agent, or Firm* — Stratford Managers Corporation

(57) ABSTRACT

A method and system of compensating for localized phenomena in a display is disclosed. The display array includes a plurality of normal pixels, a plurality of reference pixels distributed across the display array, and a controller for adjusting content data signals for the plurality of normal pixels to compensate for aging of the pixels in the array. The controller determines the effect of a localized phenomena on each of the normal pixels based on a difference between a parameter of the effected normal pixels and the parameter of the effected reference pixel in proximity thereto. An adjusted aging compensation value based on a function of the difference in the parameters associated with the localized phenomena is calculated by the controller. The adjusted aging compensation values are applied to data content signals of the effected normal pixels, and the original aging compensation values are applied to the normal pixels not effected by the localized phenomena.

16 Claims, 6 Drawing Sheets

Related U.S. Application Data continuation of application No. 14/561,697, filed on Dec. 5, 2014, now Pat. No. 9,761,170.

(60) Provisional application No. 61/912,926, filed on Dec. 6, 2013.

(52) U.S. Cl.
CPC . *G09G 2320/041* (2013.01); *G09G 2320/043* (2013.01); *G09G 2320/045* (2013.01)

(56) References Cited

U.S. PATENT DOCUMENTS

| | | | | |
|---|---|---|---|---|
| 9,761,170 | B2 * | 9/2017 | Chaji | G09G 3/3208 |
| 10,186,190 | B2 * | 1/2019 | Chaji | G09G 3/3208 |
| 2003/0048243 | A1 * | 3/2003 | Kwasnick | G09G 3/3208 345/82 |
| 2004/0150590 | A1 * | 8/2004 | Cok | G09G 3/3208 345/76 |
| 2006/0038758 | A1 * | 2/2006 | Routley | G09G 3/3233 345/81 |
| 2006/0066533 | A1 * | 3/2006 | Sato | G09G 3/20 345/76 |
| 2009/0201281 | A1 * | 8/2009 | Routley | G09G 3/3233 345/212 |
| 2015/0161942 | A1 * | 6/2015 | Chaji | G09G 3/3208 345/78 |

* cited by examiner

CORRECTION FOR LOCALIZED PHENOMENA IN AN IMAGE ARRAY

CROSS REFERENCE TO RELATED APPLICATION

This application is a continuation of U.S. patent application Ser. No. 15/675,297 filed Aug. 11, 2017, now allowed, which is a continuation of U.S. patent application Ser. No. 14/561,697, now U.S. Pat. No. 9,761,170, which claims the benefit of U.S. Provisional Application No. 61/912,926, filed Dec. 4, 2013, which are all is hereby incorporated by reference in their entireties.

TECHNICAL FIELD

The present invention relates to semiconductor arrays such as those used in display panels and more specifically to a system to compensate for localized phenomena in OLED displays.

BACKGROUND

Displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs tend to demonstrate non-uniform behavior across display panels and over time as the displays age. Compensation techniques can be applied to such displays to achieve image uniformity across the displays and to account for degradation in the displays as the displays age.

Some schemes for providing compensation to displays to account for variations across the display panel and over time utilize monitoring systems to measure time dependent parameters associated with the aging (i.e., degradation) of the pixel circuits. The measured information can then be used to inform subsequent programming of the pixel circuits so as to ensure that any measured degradation is accounted for by adjustments made to the programming. Such monitored pixel circuits may require the use of additional transistors and/or lines to selectively couple the pixel circuits to the monitoring systems and provide for reading out information. The incorporation of additional transistors and/or lines may undesirably decrease pixel-pitch (i.e., "pixel density").

Another source of distortion may be localized phenomena such as the content of the data displayed by a pixel array, temperature effects, pressure on the screen or incidental light. For example, higher localized temperature may result in a distorted higher input data into the compensation equation which distorts the correction for aging effects. Thus, the input data for pixels may require additional compensation for effects based on the localized phenomena on a pixel display in obtaining accurate aging compensation for such pixels.

SUMMARY

One disclosed example is a method of compensating for localized phenomena in a display device including an array of pixels and a controller for adjusting content data signals for the array of pixels to compensate for aging of the pixels in the array. A parameter of at least one of the pixels in the array is measured. The effect of a localized phenomena using the parameter is determined. A characteristic is measured for at least one of the pixels in the array. The measured characteristic is adjusted to reduce the effect of the localized phenomena. An adjusted aging compensation value is calculated based on the adjusted measured characteristic. The aging compensation value is applied to a data content signal to at least one of the pixels.

Another disclosed example is a display device including a display array having a plurality of pixels. The plurality of pixels each include a write input to write data content and a read input. A controller is coupled to the display array. The controller is operable to measure a parameter of at least one of the pixels in the array via the read input of the at least one of the pixels. The controller is operable to determine the effect of a localized phenomena on the pixel using the parameter. The controller is operable to measure a characteristic for at least one of the pixels in the array via the read input of the at least one of the pixels. The controller is operable to adjust the measured characteristic to reduce the effect of the localized phenomena. The controller is operable to calculate an adjusted aging compensation value based on the adjusted measured characteristic. The controller is operable to apply the aging compensation value to a data content signal to the write input of at least one of the pixels.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent upon reading the following detailed description and upon reference to the drawings.

Figure 1:
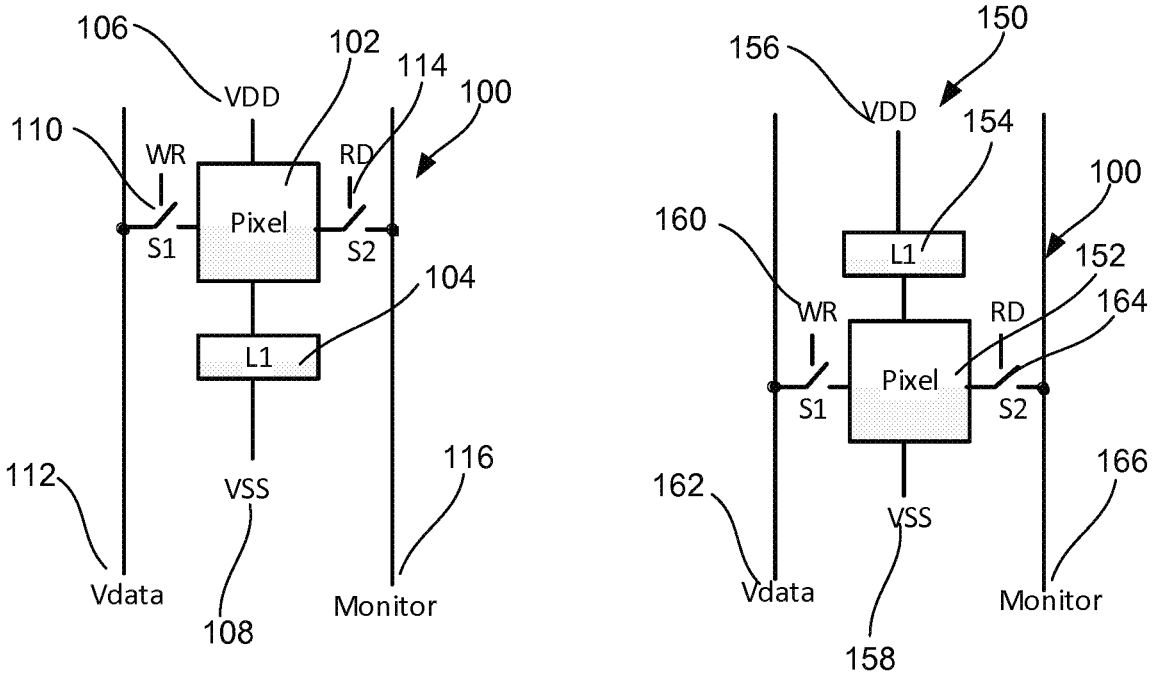
FIG. 1 shows two different pixel architectures used in semiconductor display arrays.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 shows two pixel architectures for a semiconductor display array, such as an array used in an OLED type displays. FIG. 1 shows a first pixel architecture 100 that includes a driving circuit 102, a load 104 that is coupled in series between a voltage supply (VDD) 106 and a voltage supply (VSS) 108. A write switch 110 allows data from an input line 112 to be programmed to the driving circuit 102. A read switch 114 allows a monitor line 116 to read the output from the driving circuit 102. In this example, the load 104 is a load that is driven by the pixel or resets the internal pixel circuit. The driving circuit 102 is the driving or amplifying part of the circuit that powers the pixel in the display array.

FIG. 1 also shows a second pixel architecture 150 that includes a driving circuit 152, a load 154 that is coupled in series between a voltage source (VDD) 156 and a voltage source (VSS) 158. A write switch 160 allows data from an input line 162 to be programmed to the driving circuit 152. A read switch 164 allows a monitor line 166 to read the output from the driving circuit 152. In this example, the load 154 is a load that is driven by the pixel or resets the internal pixel circuit. The driving circuit 152 is the driving or amplifying part of the circuit that powers the pixel in the display array. In both pixel architectures 100 and 150, the respective input lines 112 and 162 and monitor lines 116 and 166 are coupled to a controller which programs the respective pixels via the input lines 112, 162 controlled by the write switches 110 and 160 and monitors the respective pixels via the monitor lines 116 and 166 controlled by the read switches 114 and 164. In this example, the pixels driven by the drivers 102 and 152 are organic light emitting devices (OLEDs) which may include components such as thin film transistors that may have operating characteristics that change over age.

One method to extend the semiconductor array lifetime and/or improve the array uniformity is external compensation for the effects of aging on OLEDs. In this example, the backplane and load input characteristics for the display array are measured and the backplane and load characteristics data is used to compensate for lifetime and uniformity of the OLEDs by the controller.

Some localized phenomena effects that depend on either the content displayed by the array or localized environmental issues can cause a divergence in the aging compensation function based on the influence of measured input characteristics data. For example, when the semiconductor array is used in a display device, the displayed content on the pixels can affect the voltage distribution or localized temperatures throughout the display. Therefore, if the backplane and load characteristics are measured during the display of different content, the measured characteristics will vary due to localized phenomena. In this case, the compensation is based on accumulated changes in the characteristics, and thus the compensation will diverge over time and cause errors because of the localized display of different content. Another example of localized phenomena may be increased temperature to certain pixels in an array such as exposure to sunlight on one part of the display. The increased temperature from the sunlight may affect the voltage distribution or localized temperatures for pixels in the area exposed to the sunlight and therefore the measured input characteristics will vary for those pixels. Similar to content effects, the compensation is based on accumulated changes in the characteristics, and thus the compensation will diverge over time and cause errors because of the localized temperature effects.

To improve the aging compensation performance, the unwanted effect of localized phenomena may be removed from the extracted characteristics. Three example techniques to determine the effect of localized phenomena using at least one parameter of at least one of the pixels on the array may include: a) modeling based on pixel characteristics; b) use of reference pixels; and c) use of reference loads. Once the effect of localized phenomena is determined, it may be removed from characteristics that are input into the aging compensation equation for the pixels. These techniques to determine the effect of localized phenomena will be described below.

One example technique is using modeling to determine the effect of localized phenomena. In this technique, the pixel characteristics are measured at a few points such as at different input current values. The points may be taken during a time period of device operation that is sufficient to account for the effect of the localized phenomena. Based on the measurement points, the changes in different parameters are calculated. Such parameters may include mobility, threshold voltage, OLED voltage, and OLED off-current. The effect of the localized phenomena is calculated based on simplified models (e.g., temperature variation, voltage distribution, etc.) using the changes in the parameters. The compensation values for localized phenomena are extracted for the array device from the results of the models.

The measured parameter of the display circuit such as the architectures 100 or 150 in FIG. 1 is used to fine tune the calculated localized phenomena. In one example, a parameter that is mainly affected by localized phenomena (e.g., mobility) is selected to estimate the localized phenomena. Then the effect of estimated localized phenomena is calculated on other parameters (e.g., off voltage (threshold voltage shift)) that are measured at different points. The measured points are input to a model to determine the effects of the localized phenomena.

For example, a first order model may suggest that mobility (gain) of a device changes by 5% for every 10° C. Therefore, if the resulting measurements of two points from the pixel characteristics show that the mobility changes by 10% an estimate may be made that the temperature changed by 20° C. Also, knowing the effect of temperature change on the other parameters (e.g., threshold voltage) allows an estimate to be made of how much of the measured changes in the parameters is due to the temperature change (20° C.) and how much is due to aging.

In another example, the rate of change in the parameter may be used to extract the effect of localized phenomena. For example, in case of temperature variation and content dependent voltage redistribution, the changes in the parameter are fast while aging is a very slow process. In one case, a low pass filter may remove all the fast changes in the measurement to eliminate the effect of localized parameters. The filtered characteristic measurement may then be used as an input to the aging compensation algorithm. In another case, a low-pass filter may be employed on the extracted parameters to eliminate the effect of localized phenomena in the form of changes that occur quickly indicating the effect of localized phenomena in contrast with gradually occurring changes that occur as a result of aging.

In another example, the rate of change and dependency of the parameters to the localized phenomena may be used to extract the effect of localized phenomena. The compensation values may be corrected based on the fine-tuned localized phenomena. After estimating the effect of localized phenomena on each parameter from previous steps, this effect may be removed from those parameters by subtracting or dividing the parameters with the estimated effect for example. Then the modified parameter may be used to create the compensation values. For example, the compensation values for threshold voltage shift may be a simple addition of the shift in the extracted parameter to the input signals.

The order of the aforementioned procedure can be changed. Alternatively, only on the measured parameters may be relied upon to calculate the localized phenomena.

Figure 2:
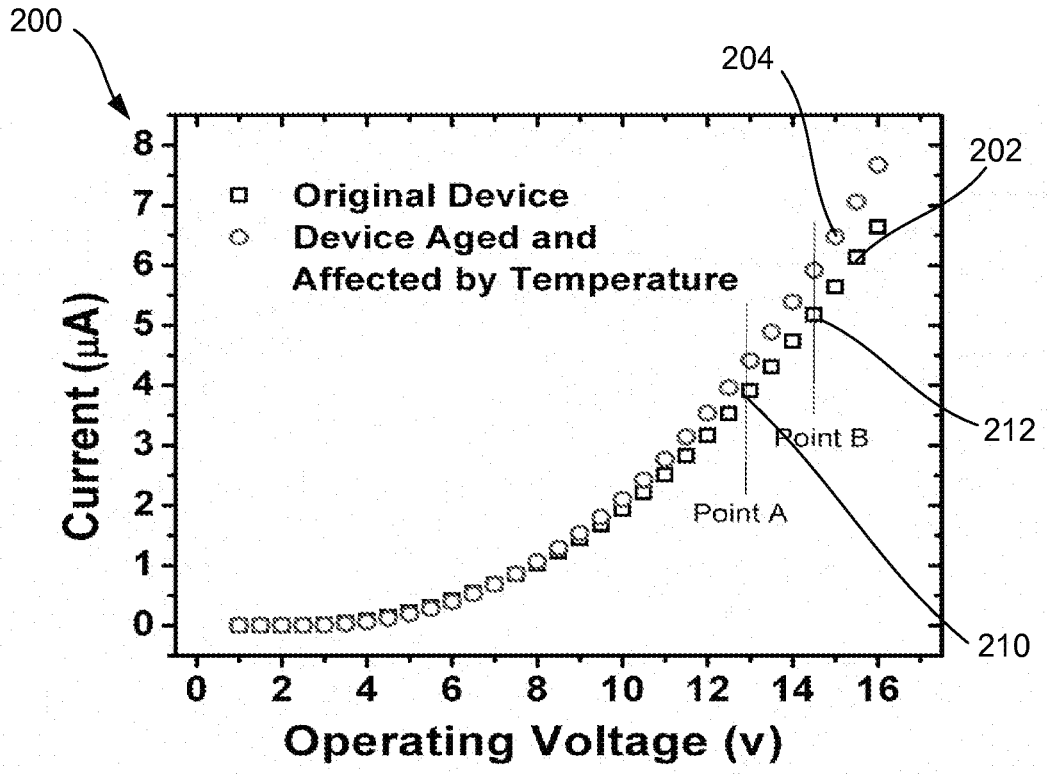
FIG. 2 is a graph of current versus operating voltage for an original device and a device aged and affected by temperature.

FIG. 2 is a graph 200 of current versus operating voltage for an original device and a device after aging and also affected by a localized phenomena such as temperature. A first line 202 shows the plot of current versus operating voltage for an original device. A second line 204 shows the plot of current versus operating voltage for a device affected by aging and temperature. As may be seen in line 204 in FIG. 2, aging and temperature distort the operating characteristics of the device. In this example, the device off voltage is increased by 0.5 V due to aging effects and its gain is increased by 25% due to the localized phenomena of temperature. Thus, due to temperature effect, the affected device has a higher current. The output of the affected device may be compensated for aging based on many different techniques. However, compensation for aging alone would still result in deviation from the original device due to the localized phenomena such as temperature.

To eliminate this effect, two points may be measured for the device to extract the temperature effect based on modeling. The measurement of a device characteristic may then be adjusted from the results of the modeling to eliminate the effect of the temperature. The adjusted measured characteristic may then be input to the aging compensation technique. In this example, a parameter such as the operating voltage measured at a first current (point A) 210 and at a second current (point B) 212. Using a linear model for current-voltage characteristics, the change in the gain may be extracted as 19% and the change in the off voltage as 0.22 V from the two operating voltage points. The determined change in gain is based on the localized phenomena and may then be used to correct the measured input characteristics when the compensation for aging of the pixel device is determined.

However, use of a more sophisticated non-linear model of the current-voltage characteristics based on the two measurements results in the determination of a change in the gain of 24.9% and that the off-voltage is changed by 0.502 V. Thus, depending on the required accuracy and the computation power available, different models may be used to determine the effects of localized phenomena and thus the accuracy of the adjustment of the measured input characteristic to the aging compensation techniques. The model output may be made on more than two parameter points of the device for greater accuracy of the modeling results. The parameter points of each pixel on the array may be measured, or the parameter points of certain selected pixels at predetermined intervals in the array may be measured for purposes of inputs to the model.

Figure 8A:
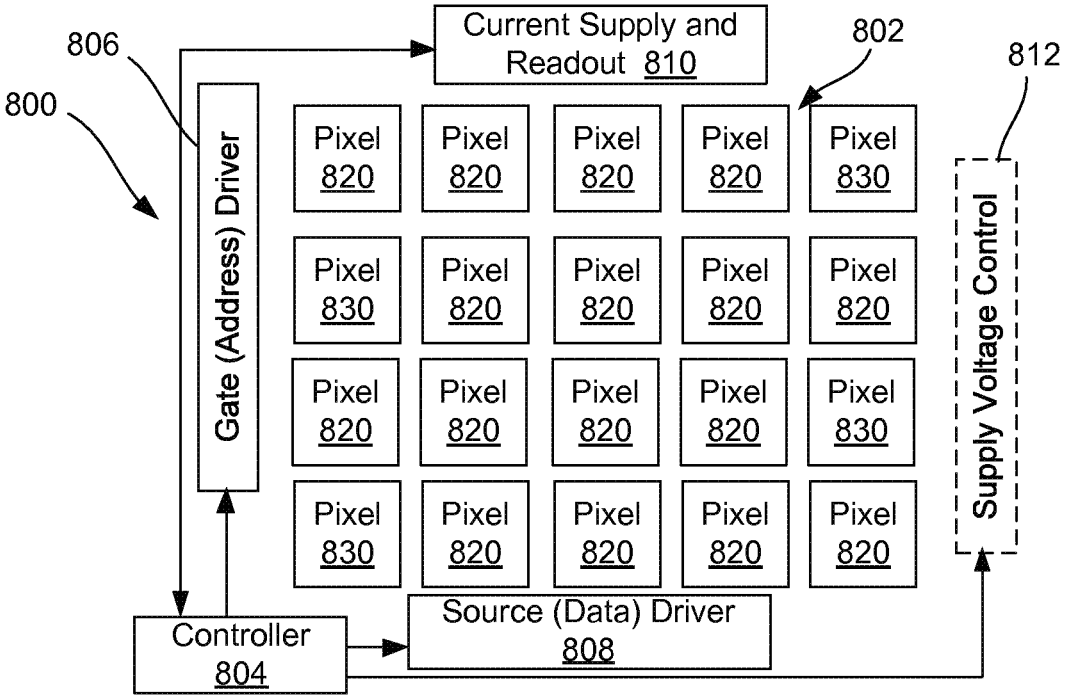
FIG. 8A is a block diagram of a display array including reference pixels for correction for localized phenomena.

A second technique to determine the effect of localized phenomena may be the use of reference pixels. FIG. 8A shows a panel display device 800 which includes a pixel array 802 that is controlled by a controller 804. The controller 804 accesses individual pixels via an address driver 806. Content is displayed on the pixel array 802 via a data driver 808. Current is supplied and read via a current supply and readout unit 810. A supply voltage control 812 regulates the voltage to the pixels in the pixel array 802.

As shown in FIG. 8A, a panel display device 800 may include normal pixels 820 and some reference pixels 830 distributed across the pixel array 802. The normal pixels 820 receive content data inputs from the data driver 808 and display the content. The reference pixels 830 are identical in structure to the normal pixels 820. However, the status of the reference pixels 830 remains the same since such pixels are not coupled to data inputs from a controller 804. Thus, the reference pixels 830 are either not aged or aged with a known state because they are not connected to content data signals. In this example, a parameter of both the normal pixels 820 and the reference pixels 830 are measured in the same way via the current readout 810. The difference in parameter values measured between a reference pixel 830 and a normal pixel 820 in proximity to the reference pixel 830 is associated with the effect of the localized phenomena. For example, the difference between a parameter value of the reference pixel and a normal pixel is indicative of aging effects, since the normal pixel is subject to aging but reference pixel is not. The absolute parameter value after eliminating the difference in parameter values from the normal pixel is indicative of the effect of the localized phenomena since the localized phenomena affects both the normal pixel and a reference pixel in close proximity to the normal pixel.

A reference map may be developed for the entire pixel array 802 based on the measurements from the reference pixels 830 in the pixel array 802. The reference map may then be used to determine the effects of the localized phenomena for each pixel 820 in the pixel array 802.

In one example, the reference map is an interpolation of the measured value for all other pixels based on the reference pixel measurement values. In this case, the measured values of the other pixels are corrected by the reference value associated with that pixel (e.g. the two values are either subtracted or divided). The resulting corrected value is used to adjust the measured characteristic used to calculate an adjusted aging compensation value for a pixel in the array.

In another example, the reference map is an interpolation of the extracted parameters for other pixels based on the reference pixel parameters. The parameters extracted for each pixel based on its own measurement data is tuned by the reference parameter maps (e.g., a model may be used to eliminate the unwanted effects from the extracted parameters).

The reference measurements from the reference pixels 830 may be taken when the display device 800 is either on line or off line. Generally, there are fewer reference pixels than normal pixels since the reference pixels are not coupled to content data inputs. The number of reference pixels therefore limits the display area of the pixels in the array. In this example, there is one reference pixel 830 for four normal pixels 820, but other ratios may be used. The reference pixel measurements are applied for compensation of normal pixels 820 in proximity of the reference pixel 830.

To cover the content lost associated with reference pixels in an array, the adjacent pixels may be used to create the content lost from the reference pixels. In one example shown in FIG. 8B, the pixel array 802 may include a plurality of pixel units such as the reference pixel unit 830 which each contain sub-pixels. As explained above, the reference pixel unit 830 is the same as the normal pixel unit 820 except that some or all of the subpixels in the reference pixel 830 are not coupled to content data signals. Each pixel unit in the example pixel array 802 in FIG. 8A such as the pixel unit 830 has different sub-pixels such as a red pixel 840*a*, a green pixel 840*b*, a blue pixel 840*c* and a white pixel 840*d*. The sub-pixels 840*a*-840*d* may be used to generate color outputs from a normal pixel unit 820. In this example, some of the pixels in the pixel array 802 are reference pixels as shown in FIG. 8A. In such reference pixels such as the reference pixel 830 shown in FIG. 8B, one or more of the sub-pixels are used as reference pixels and the other sub-pixels may create the content of that would be output on the reference sub-pixel if the pixel unit operated normally. In this case, the reference pixel may be one sub-pixel such as the white pixel 840*d*. The red pixel 840*a*, green pixel 840*b* and blue pixel 840*c* may generate the white content for the white pixel 840*d* which is used as a reference pixel and thus does not emit any light.

Figure 3:
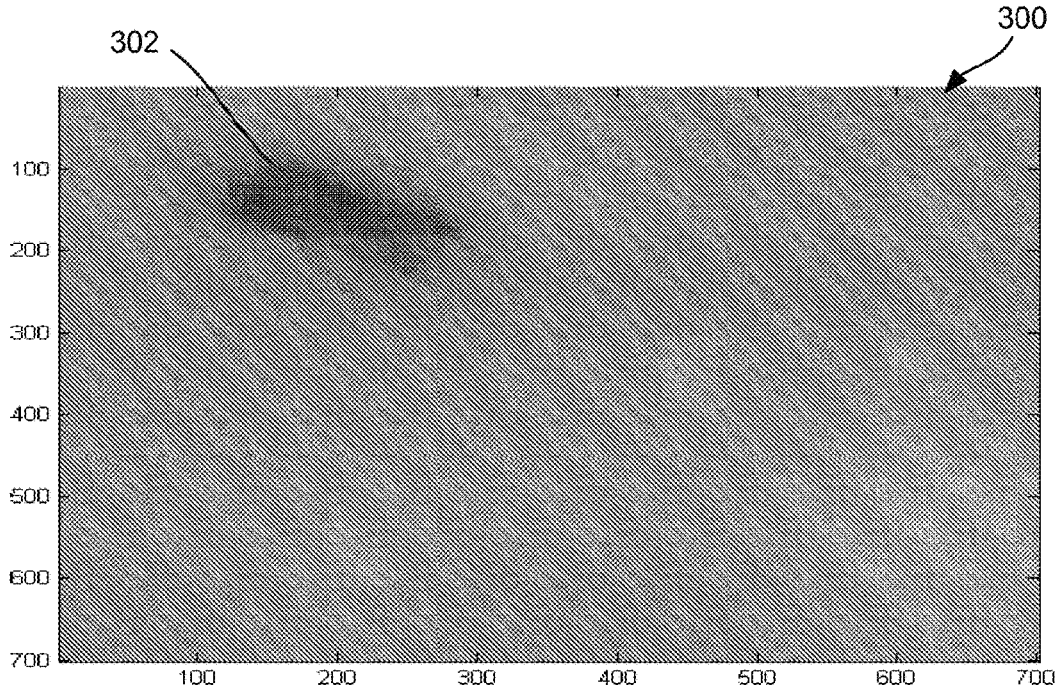
FIG. 3 is a reference map created by interpolation between measured values of reference pixels for localized phenomena from the content of a display.
Figure 4:
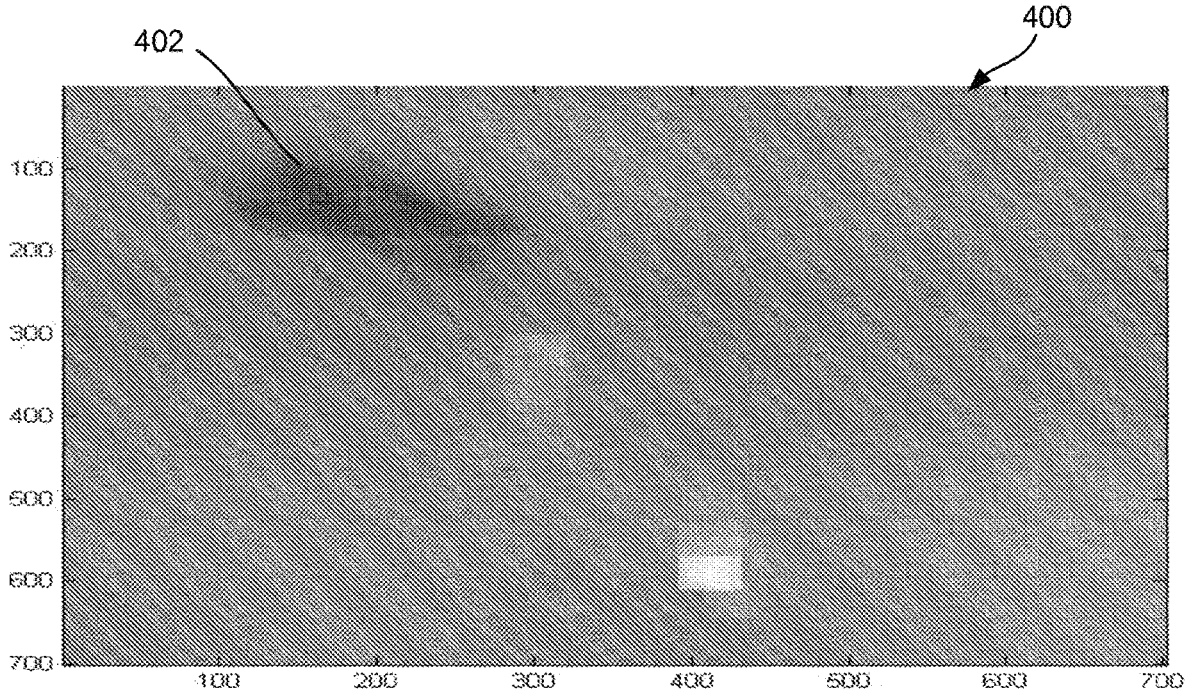
FIG. 4 is a reference map showing the original results of panel measurements including the effect of aging and localized phenomena.
Figure 5:
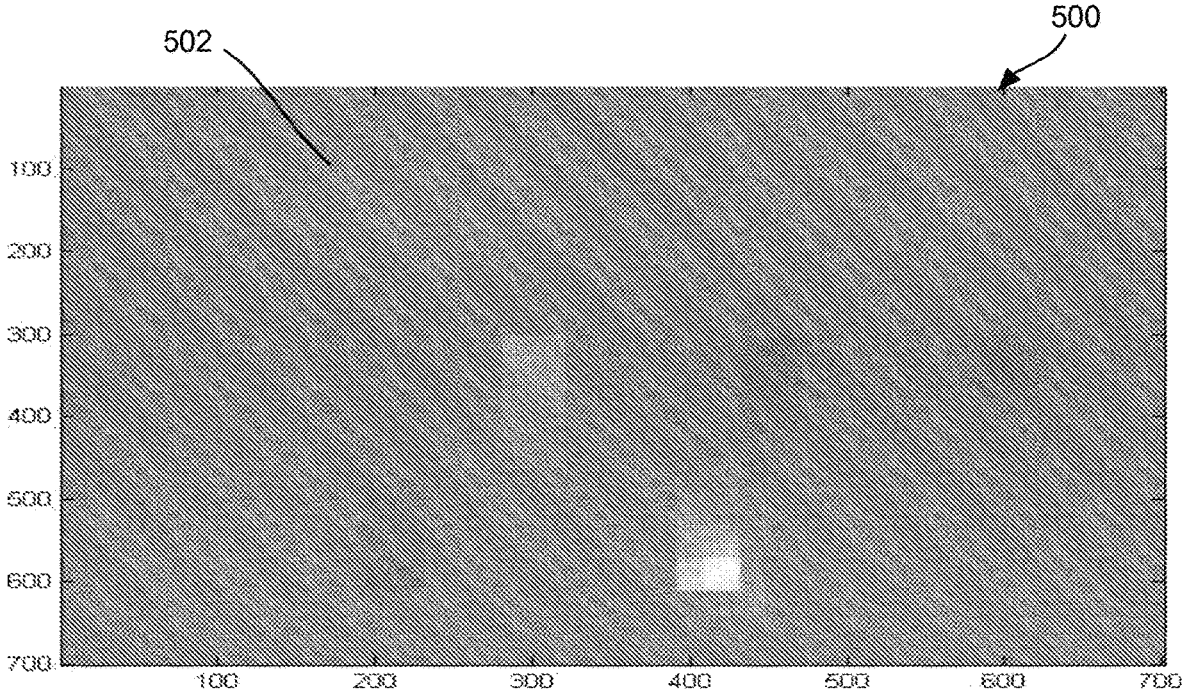
FIG. 5 is a reference map showing aging compensation results after the effect of localized phenomena are removed from the original results of the panel measurement by means of reference pixels, using simple subtraction to eliminate the effect of localized phenomena.

FIGS. 3-5 demonstrate the results of the aging algorithm on a panel with some localized phenomena and the results of using reference pixels to minimize the effect of the localized phenomena. A panel was cooled intentionally at the top-left corner with a heat sink to simulate a localized phenomena, and there were a few images displayed on the panel affecting the voltage redistribution. FIG. 3 is a reference map 300 created by interpolation between measured values of reference pixels for localized phenomena from the content of a display. The reference map 300 includes an area 302 of the localized phenomena that is created by temperatures from the heat sink in proximity to the display.

FIG. 4 shows a reference map 400 that shows the original results of panel measurements including the effect of aging and localized phenomena temperature, voltage redistribution etc.). In this example, the original results include the localized phenomena of temperature in an area 402.

Figure 8B:
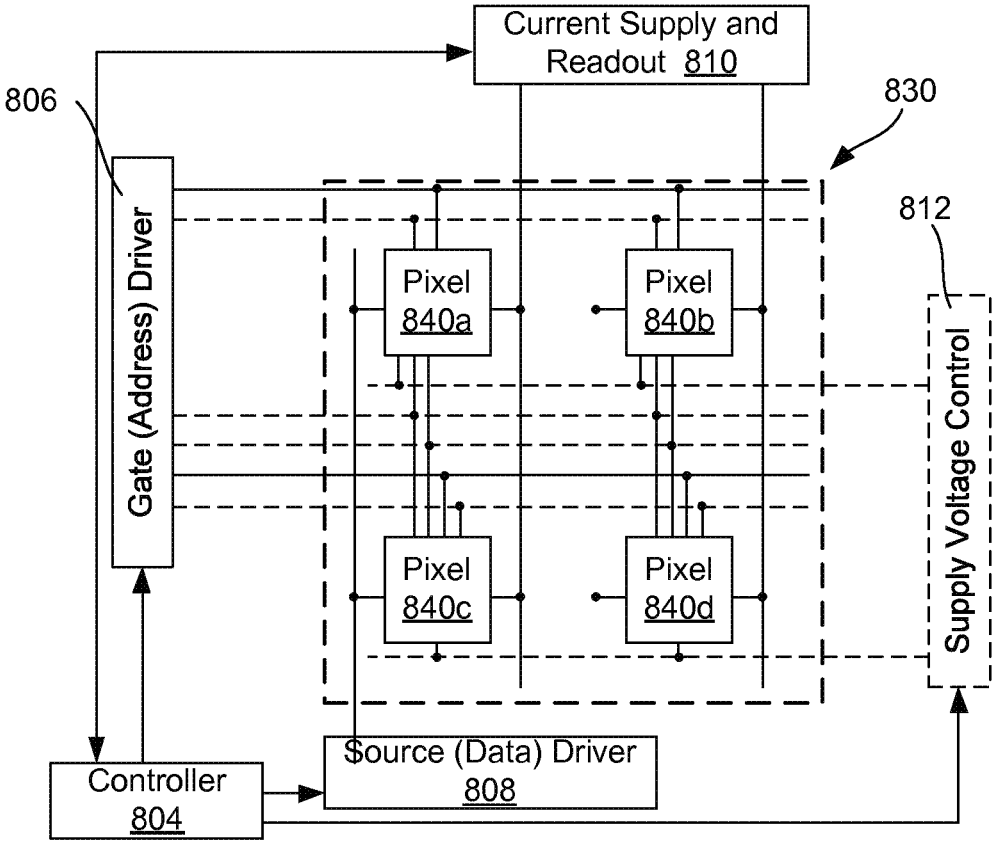
FIG. 8B is a block diagram of a pixel including subpixels that may be used as a reference pixel.

FIG. 5 shows a reference map 500 that shows the aging compensation results after the effect of localized phenomena are removed from the original results of the panel measurement by means of reference pixels such as those shown in FIGS. 8A-8B, using simple subtraction to eliminate the effect of localized phenomena. An area 502 in FIG. 5 may be contrasted to the area 402 in the reference map 400 in FIG. 4 to show that the effects related to localized phenomena have been eliminated.

A third technique to determine the effect of localized phenomena is adding extra load elements to at least some of the pixels in an array to extract the localized phenomena based on measurements from the reference loads. In this technique, the reference load elements are not aged by content stress while the other components of the pixel architecture are aged based on content data written to the pixel. The characteristics of the reference load are compared with the characteristics of the pixel load. Therefore, the differences in the characteristics of the reference load and the pixel load can be associated with the localized phenomena (e.g. voltage redistributions, temperature variation, etc.).

Figure 6:
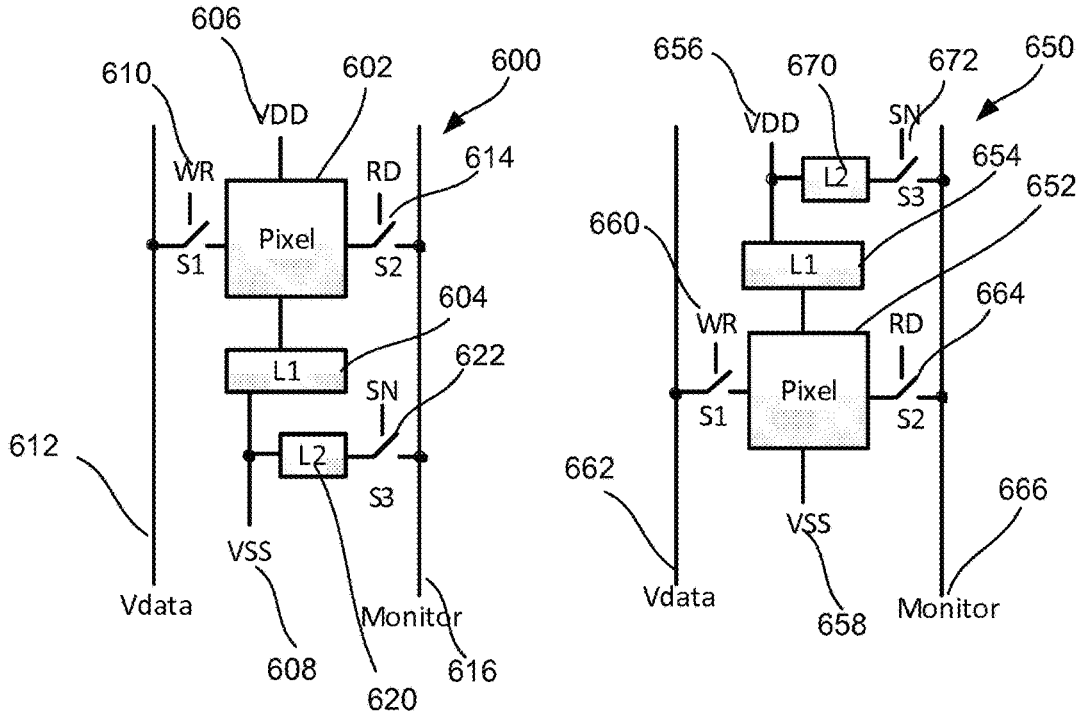
FIG. 6 show two modified pixel structures with reference loads used in semiconductor display arrays for correction for localized phenomena.

FIG. 6 shows two examples of pixel architectures using extra load elements for purposes of compensating for localized phenomena. FIG. 6 shows an example reference load pixel architecture 600 and an alternate reference load pixel architecture 650. The first reference load pixel architecture 600 includes a driving circuit 602 and a pixel load 604 that is coupled in series between a voltage source (VDD) 606 and a voltage source (VSS) 608. A write switch 610 allows data from an input line 612 to be programmed to the driving circuit 602. A read switch 614 allows a monitor line 616 to read the output from the driving circuit 602. In this example, the pixel load 604 is a load that is driven by the pixel or resets the internal pixel circuit. The driver circuit 602 is the driving or amplifying part of the circuit that powers the pixel in the display array. A reference load 620 is also coupled to the voltage ground 608 and a reference switch 622 to the monitor line 616. The reference switch 622 may be controlled by the same signal controlling either the write switch 610 or the read switch 614. Alternatively, a separate measurement line may be used for controlling the reference switch 622 to measure the reference load 620.

The alternate reference pixel architecture 650 includes a driving circuit 652 and a pixel load 654 that is coupled in series between a voltage source 656 and a voltage ground 658. A write switch 610 allows data from an input line 662 to be programmed to the driving circuit 652. A read switch 664 allows a monitor line 666 to read the output from the driver 652. In this example, the load 654 is a load that is driven by the pixel or resets the internal pixel circuit. The driving circuit 652 is the driving or amplifying part of the circuit that powers the pixel in the display array. A reference load 670 is also coupled to the voltage source 656 and a reference switch 672 to the monitor line 616. The reference switch 672 may be controlled by the same signal controlling either the write switch 660 or the read switch 664. Alternatively, a separate measurement line may be used for the reference load 670.

In one example, a reference signal applied to the switch 622 or switch 672 may be either the read signal applied to the respective read switch 614 or 664 to read from the respective pixel drivers 602 and 652. A parameter or characteristic of reference loads 620 or 670 is measured in order to compare parameters or characteristics with elements in the pixel driver. In this example, the reference load may include similar components to the actual pixels on a display such as a driving transistor or a pixel circuit. However, the reference load does not include every component in the actual pixel architecture and therefore does not take up the space of a reference pixel as in the example explained above. During the measuring of the characteristics of the reference loads 620 or 670, the pixel itself may be programmed with the signal off state or if the pixel content has negligible effect on the measurement from the reference load, the pixel may be programmed with its content, and the read signal is off from the respective read switches 614 and 664 being open.

Thus, the characteristics of the reference loads 620 or 670 may be extracted via the respective read lines 616 and 666 in this example. In this case, any change to the power source lines (e.g., VSS or VDD) will be part of the measured data for the reference load. The characteristics of the pixel loads 604 or 654 may be extracted by the respective read lines 616 and 666 in this example. During the extraction, the reference switches 622 or 672 are open, so the reference loads 620 and 670 are not read. The read characteristics of the reference load and the pixel load are compared to determine the effect of the localized phenomena.

In addition, any other localized phenomena may be measured if it affects the reference load. To improve the correction for the effect of localized phenomena on the pixel and the characteristics of the load 604 or 654, different reference load elements may be used. Some of the reference load elements may match the load 604 or 654 and other reference loads may match the pixel driving circuit 602 or 652. In another example, a different reference load may be used for measuring the effect of different localized phenomena. Some or all of the pixels in the display array may have reference load elements depending on the desired accuracy and processing overhead. The reference measurements from the reference load elements may be taken when the display is either on line or off line.

Figure 7:
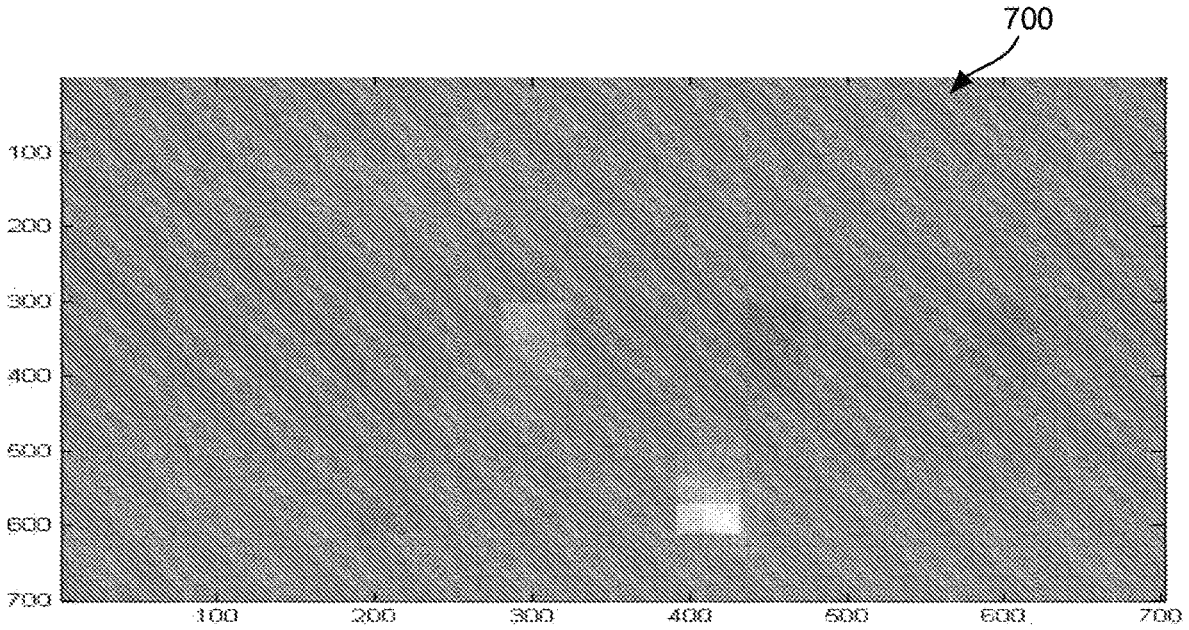
FIG. 7 is a reference map showing aging compensation results after the effect of localized phenomena are removed from the original results of the panel measurement by means of reference loads.

FIG. 7 is a reference graph 700 that shows aging results after the effect of localized phenomena are removed from the original results of the panel measurement by means of reference loads such as by the architectures 600 and 650 in FIG. 6. The reference graph 700 shows the results of using a reference load on the same panel represented in the architectures in FIG. 6. As may be seen by FIG. 7, the results may have higher resolution with less interpolation error since the number of reference loads may be higher resulting in more input data than the smaller amount of data limited by the relatively smaller number of reference pixels without affecting image quality.

Figure 9:
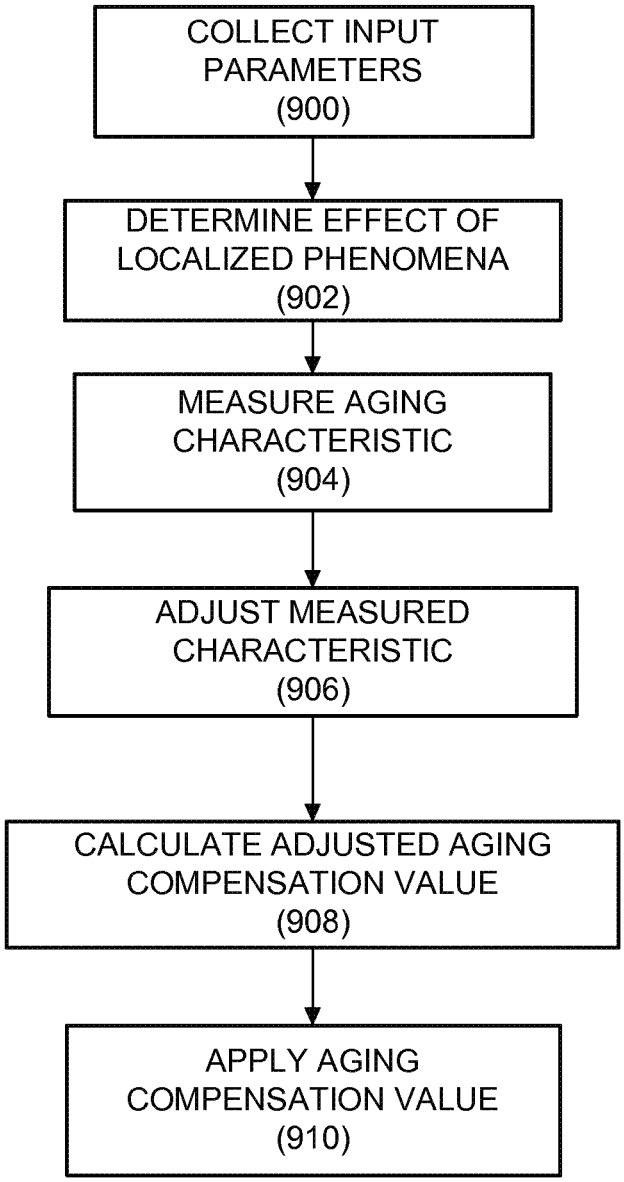
FIG. 9 is a flow diagram of the process to correct for localized phenomena in a semiconductor array display.

FIG. 9 is a flow diagram of the process of compensation for aging as well as localized phenomena in a display array. Initially relevant input parameters are collected (900). The relevant input parameters may be points from pixel characteristics or measurements of characteristics from reference pixels or a reference load. The effect of the localized phenomena is determined based on the relevant input parameter or parameters (902). A characteristic is then measured from at least one pixel in the array for aging compensation (904). The measured characteristic from a pixel is then adjusted to reduce the effect of the localized phenomena (906). The adjusted measured characteristic is then input into a compensation equation to calculate an adjusted aging compensation value (908). The compensation value is then applied to adjust a data content signal for a pixel to compensate for the effects of aging (910).

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A display device comprising:

a display array including a plurality of normal pixels, and a plurality of reference pixels distributed across the display array;

a data driver for transmitting content data signals to the normal pixels, but not the reference pixels; and a controller coupled to the display array, the controller configured for:

adjusting content data signals for the plurality of normal pixels using an original aging compensation value or an adjusted aging compensation value for each normal pixel;

determining an effect of a localized phenomena on each of the normal pixels based on a difference between a parameter of effected normal pixels and the parameter of an effected reference pixel in proximity thereto;

adjusting the original aging compensation values as a function of the difference in the parameters associated with the localized phenomena to reduce the effect of the localized phenomena on the effected normal pixels to generate the adjusted aging compensation values;

applying the adjusted aging compensation values to content data signals of the effected normal pixels; and applying the original aging compensation values to content data signals of the normal pixels not effected by the localized phenomena.

2. The display device according to claim 1, wherein the display array comprises a plurality of pixel units, each pixel unit with a plurality of different colored normal pixels coupled to the data driver for generating a colored output, and one reference pixel not coupled to the data driver.

3. The display device according to claim 1, wherein the controller is also configured for developing a reference map for the entire display array based on parameter values measured from the reference pixels.

4. The display device according to claim 3, wherein the reference map comprises interpolated reference pixel parameter values based on the parameter values obtained from the reference pixels.

5. The display device according to claim 3, wherein determining an effect of a localized phenomena includes determining a difference between the parameter value of the reference pixel and a parameter value of the normal pixel; and determining an absolute value of the parameter of the normal pixel after eliminating the difference between the parameter values.

6. The display device according to claim 1, wherein the localized phenomena is selected from the group consisting of: content displayed by the pixels from data content signals, and temperature.

7. The display device according to claim 1, wherein the parameter is selected from the group consisting of: mobility, threshold voltage, organic light emitting device (OLED) voltage, and OLED off-current.

8. The display device according to claim 1, wherein there is one reference pixel for every four normal pixels.

9. A method of compensating for localized phenomena in a display device including a plurality of normal pixels, a plurality of reference pixels distributed across the display device, and a controller for adjusting content data signals for the plurality of normal pixels using original aging compensation values to compensate for aging of the normal pixels, said method comprising;

determining an effect of the localized phenomena on each of the normal pixels based on a difference between a parameter of effected normal pixels and the parameter of an effected reference pixel in proximity thereto;

adjusting the aging compensation values as a function of the difference in the parameters associated with the localized phenomena to reduce the effect of the localized phenomena on the effected normal pixels to generate adjusted aging compensation values;

applying the adjusted aging compensation values to content data signals of the effected normal pixels; and applying the original aging compensation values to content data signals for the normal pixels not effected by the localized phenomena.

10. The method according to claim 9, wherein the display device comprises a plurality of pixel units, each pixel unit with a plurality of different colored normal pixels coupled to a data driver for generating a colored output, and one reference pixel not coupled to the data driver.

11. The method according to claim 9, further comprising developing a reference map for the entire display array based on parameter values measured from the reference pixels.

12. The method according to claim 11, wherein the reference map comprises interpolated reference pixel parameter values based on the parameter values obtained from the reference pixels.

13. The method according to claim 11, wherein determining an effect of the localized phenomena includes determining a difference between the parameter value of the reference pixel and a parameter value of the normal pixel; and determining an absolute value of the parameter of the normal pixel after eliminating the difference between the parameter values.

14. The method according to claim 9, wherein the localized phenomena is selected from the group consisting of: content displayed by the pixels from data content signals, and temperature.

15. The method according to claim 10, wherein the parameter is selected from the group consisting of: mobility, threshold voltage, organic light emitting device (OLED) voltage, and OLED off-current.

16. The method according to claim 9, wherein there is one reference pixel for every four normal pixels.

* * * * *